US008839940B2

(12) United States Patent
Guan et al.

(10) Patent No.: US 8,839,940 B2
(45) Date of Patent: Sep. 23, 2014

(54) SELF-LOCKING TYPE SHUTTER DEVICE

(75) Inventors: Zeyan Guan, Guangzhou (CN); Xiaodian Chen, Guangzhou (CN); Dong Wei, Guangzhou (CN); Nian Wang, Guangzhou (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 53 days.

(21) Appl. No.: 13/500,275

(22) PCT Filed: Sep. 26, 2010

(86) PCT No.: PCT/CN2010/077317

§ 371 (c)(1),
(2), (4) Date: Apr. 4, 2012

(87) PCT Pub. No.: WO2011/054240

PCT Pub. Date: May 12, 2011

(65) Prior Publication Data

US 2012/0192771 A1 Aug. 2, 2012

(30) Foreign Application Priority Data

Nov. 6, 2009 (CN) ..... 2009 1 0193709

(51) Int. Cl.
*G07F 1/00* (2006.01)
*G07D 11/00* (2006.01)

(52) U.S. Cl.
CPC ..... *G07D 11/0018* (2013.01); *Y10S 902/08* (2013.01); *Y10S 902/17* (2013.01)
USPC ..... 194/351; 194/344; 194/350; 902/8; 902/17

(58) Field of Classification Search
CPC ..... G07D 11/0018
USPC ..... 74/24, 25, 42, 47, 48, 51, 469, 490.15; 49/28, 140, 324, 333–337, 339–342, 49/345, 358; 194/344, 350, 351; 902/8–21, 41
See application file for complete search history.

(56) References Cited

U.S. PATENT DOCUMENTS 2,813,712 A * 11/1957 Stanis ..... 267/257
4,889,175 A * 12/1989 Frey et al. ..... 160/90

(Continued)

FOREIGN PATENT DOCUMENTS

CN 101482992 A 7/2009
CN 101840595 A 9/2010

(Continued)

OTHER PUBLICATIONS

International Search Report dated Dec. 30, 2010 from corresponding International Application No. PCT/CN2010/077317.

(Continued)

*Primary Examiner* — Jeffrey Shapiro
(74) *Attorney, Agent, or Firm* — Wolf, Greenfield & Sacks, P.C.

(57) ABSTRACT

A self-locking type shutter device is provided. The device is arranged in a financial self-service equipment, so as to open or close a cash depositing/withdrawing port (1) of the financial self-help service equipment. The device comprises a frame (3) integrally welded, a gate (2) and a power transmission mechanism. The gate (2) is arranged on the frame (3) by a first rotation shaft (4) and can rotate around the first rotation shaft (4). The power transmission mechanism is fixed on the frame (3), so as to provide the gate (2) with rotation power. The power transmission mechanism comprises a motor (5) and at least one unidirectional folding linkage mechanism (70). The device can be self-locked via the unidirectionally folding linkage mechanism (70).

5 Claims, 4 Drawing Sheets

(56) References Cited

U.S. PATENT DOCUMENTS

| | | | | |
|---|---|---|---|---|
| 5,454,332 | A * | 10/1995 | Fennelly et al. | 109/19 |
| 6,843,409 | B2 | 1/2005 | Park | |
| 8,459,437 | B2 * | 6/2013 | Guan et al. | 194/347 |
| 2001/0000644 | A1 * | 5/2001 | Lewis et al. | 312/223.1 |
| 2002/0178655 | A1 * | 12/2002 | Pedemonte | 49/339 |
| 2003/0121971 | A1 * | 7/2003 | Lee | 235/379 |
| 2004/0041397 | A1 * | 3/2004 | Murphy | 285/197 |
| 2004/0245328 | A1 * | 12/2004 | Schaper et al. | 232/10 |
| 2005/0145767 | A1 * | 7/2005 | Nakagaki et al. | 248/345.1 |
| 2007/0148409 | A1 * | 6/2007 | Rios et al. | 428/167 |
| 2008/0128488 | A1 * | 6/2008 | Ryan et al. | 235/379 |
| 2009/0025297 | A1 * | 1/2009 | Hsu | 49/341 |
| 2009/0265992 | A1 * | 10/2009 | Hass et al. | 49/340 |
| 2012/0192771 | A1 * | 8/2012 | Guan et al. | 109/66 |

FOREIGN PATENT DOCUMENTS

| | | | |
|---|---|---|---|
| CN | 101840596 | A | 9/2010 |
| JP | 2009035911 | A | 2/2009 |
| WO | WO 9633694 | A1 | 10/1996 |
| WO | WO 2008111148 | A1 | 9/2008 |

OTHER PUBLICATIONS

European Search Report dated Apr. 8, 2013 from corresponding European Application No. 10827854.0.

Patent Examination Report No. 1 dated Mar. 20, 2013 from corresponding Australian application No. 2010314624.

* cited by examiner

SELF-LOCKING TYPE SHUTTER DEVICE

The present application is a U.S. National Stage Patent Application of International Application No. PCT/CN2010/077317, filed on Sep. 26, 2010, which application claims the benefit of priority to Chinese patent application No. 200910193709.7, filed with the Chinese State Intellectual Property Office on Nov. 6, 2009. The entire disclosures thereof are incorporated herein by reference.

FIELD OF THE INVENTION

The present invention relates to a cash inlet/outlet gate device for financial self-service instruments, and more particularly, to a self-locking gate device.

BACKGROUND OF THE INVENTION

At present, the financial self-service instruments are widely used. Independent self-service instruments may provide 24-hour uninterrupted service, so as to provide many advantages to people's lives. Unattended automatic teller machines are convenient to depositors. However, it also provides an opportunity for criminals to steal or intercept money from depositors. As the automatic teller machine is widely installed, criminal cases for the automatic teller machine are also increasing year after year. Such kind of crime mainly includes, i) illegally intercepting money from depositors by taking some actions to the cash outlet; and ii) stealing money from depositors by illegally obtaining information and passwords of bank cards of depositors.

For the first kind of crime, the financial self-service instrument needs to be equipped with a cash outlet gate which may prevent foreign matters from being inserted, prevent liquid glues, resist a certain violent damage and avoid from being illegally opened. A current cash outlet gate is generally resisted by a gate stopper in order to prevent from being illegally opened. However, in this manner, it is inevitable to form a gap between the gate and a base plate when assembling the gate, and thus criminals may move the gate stopper from the gap with a thin rigid sheet, so that the gate may be easily opened. Obviously, it is an important problem of designing the financial self-service instrument to improve the safety and reliability of the cash outlet gate and prevent the cash outlet gate from being illegally opened.

The conventional gate locking device generally has many members, and thus has a complex structure. Therefore, it is necessary to provide a self-locking cash outlet gate structure which has a simplified structure and high safety and reliability.

SUMMARY OF THE INVENTION

The object of the invention is to provide a self-locking gate structure which may prevent from being illegally opened.

The further object of the invention is to provide an anti-inserted foreign matters and anti-liquid glues sticking gate structure.

In view of the above objects, the present invention provides a self-locking gate device, installed in a financial self-service instrument and configured to open or close a cash inlet/outlet of the financial self-service instrument. The self-locking gate device includes an integral welded frame, a door and a power transmission mechanism. The door is installed on the frame through a first rotation shaft and is rotatable around the first rotation shaft. The power transmission mechanism is fixed on the frame and proving a power for the rotation of the door. The power transmission mechanism includes an electric motor and at least one one-way folded connecting rod mechanism. The one-way folded connecting rod mechanism includes a first connecting rod and a second connecting rod. The first connecting rod and the second connecting rod are hinged together through a second shaft. The other end of the first connecting rod is connected to the door through a third shaft. The third shaft and the first shaft are disposed in parallel and are respectively located at two opposite ends of the door. The other end of the second connecting rod is connected to the electric motor through a fourth shaft. The electric motor drives and rotates the fourth shaft. The second connecting rod and the fourth shaft are fixedly connected together.

Preferably, an end of the first connecting rod adjacent to the third shaft has a first end surface, and an end of the second connecting rod adjacent to the third shaft has a second end surface. When the cash inlet/outlet of the financial self-service instrument is closed by the door, the first end surface and the second end surface abut against with each other, so as to stop a folding operation formed by rotating the first connecting rod in a clockwise direction and rotating the second connecting rod in a counterclockwise direction.

Preferably, when the cash inlet/outlet is closed by the door, axes of the second shaft, third shaft and fourth shaft are in the same line, or the second shaft is located below the connecting line A between the axes of the third shaft and the fourth shaft.

Preferably, in the case that the second shaft is located below the connecting line A between the axes of the third shaft and the fourth shaft and the connecting line between the axes of the second shaft and the fourth shaft is indicated as B, a separation angle formed between A and B is ranged from 0 to 10 degree.

Preferably, a torsion spring is provided on the third shaft. An end of the torsion spring is fixedly connected to the door, and the other end of the torsion spring is fixedly connected to the first connecting rod. The torsion spring is configured to exert a force to the first connecting rod, so as to urge the first connecting rod to rotate around the third shaft in the clockwise direction.

Preferably, a rod embracing structure is formed between the second connecting rod and the fourth shaft, and the second connecting rod is configured to clamp the fourth shaft through a screw.

Preferably, the power transmission mechanism further includes a driving gear and a driven gear engaged with the driving gear, the driven gear is installed on the fourth shaft so as to rotate the fourth shaft.

Optionally, the power transmission mechanism includes a pair of one-way folded connecting rod mechanisms. The pair of one-way folded connecting rod mechanisms is connected between the door and the fourth shaft, and the pair of one-way folded connecting rod mechanisms is symmetrically located two ends of the fourth shaft.

In order to further achieve the object of preventing foreign matters from being inserted and preventing liquid glues from sticking, the edges of the door of the self-locking gate device engaged with the cash inlet/outlet of the financial self-service instrument are provided with POM plastic sphere convex dots. Preferably, the POM plastic convex sphere convex dots are distributed uniformly and equidistantly.

The self-locking gate device according to the present invention has the following advantages.

The one-way folded connecting rod mechanism is provided in the power transmission mechanism, so as to achieve the self-lock function, which may prevent the gate device from being violently destroyed by criminals. The present invention utilizes the characteristic that liquid glues available in the market don't stick the POM plastic, and the edges of the door to engaged with the cash inlet/outlet of the financial self-service instrument are provided with POM plastic sphere convex dots, thus, the flow guiding gap for liquid glues is formed, and guides liquid glues to flow out. Besides, the sphere convex dots may minimize the contact area between the gate structure and the panel of the cash inlet/outlet of the financial self-service instrument, and decrease the destructive degree of glues to the gate device, thereby preventing the gate device from being damaged by glues.

DETAILED DESCRIPTION

Hereinafter, the technical solutions in embodiments of the present invention will be described clearly and completely with reference to drawings of the embodiments of the present invention. It is apparent that the embodiments to be described are merely a portion of embodiments of the present invention, but not all of the embodiments. Based on the embodiments of the present invention, all of other embodiments made by those skilled in the art without inventive effort fall into the protection scope of the present invention.

Figure 1:
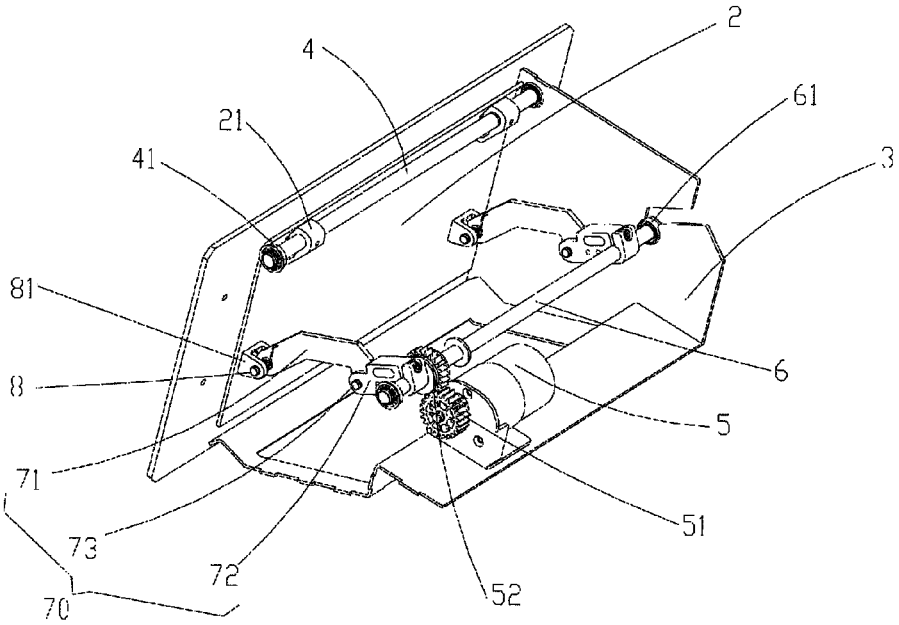
FIG. 1 is a schematic structural view of a preferred gate device according to the invention when being in the closed state.
Figure 2:
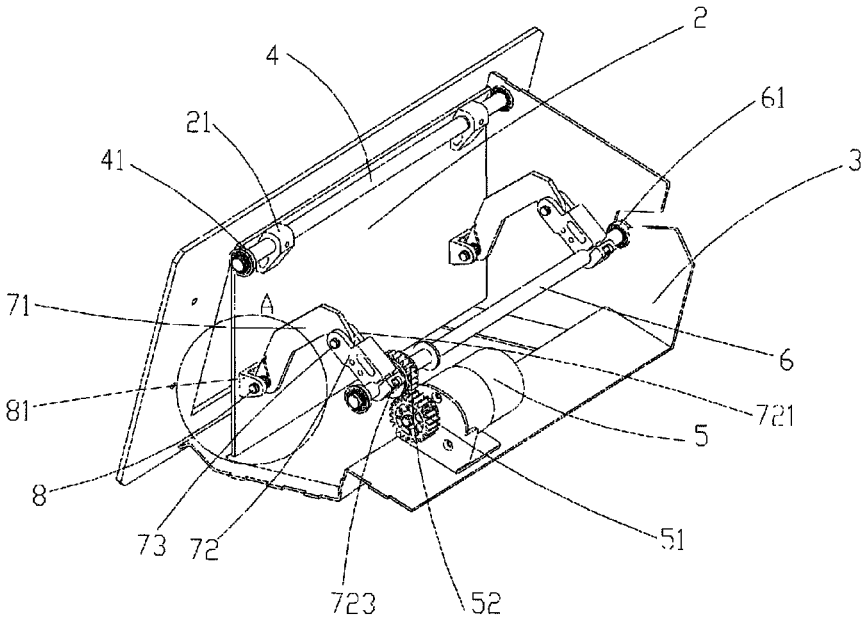
FIG. 2 is a schematic view of the gate device in FIG. 1 when being in the opening course state.
Figure 3:
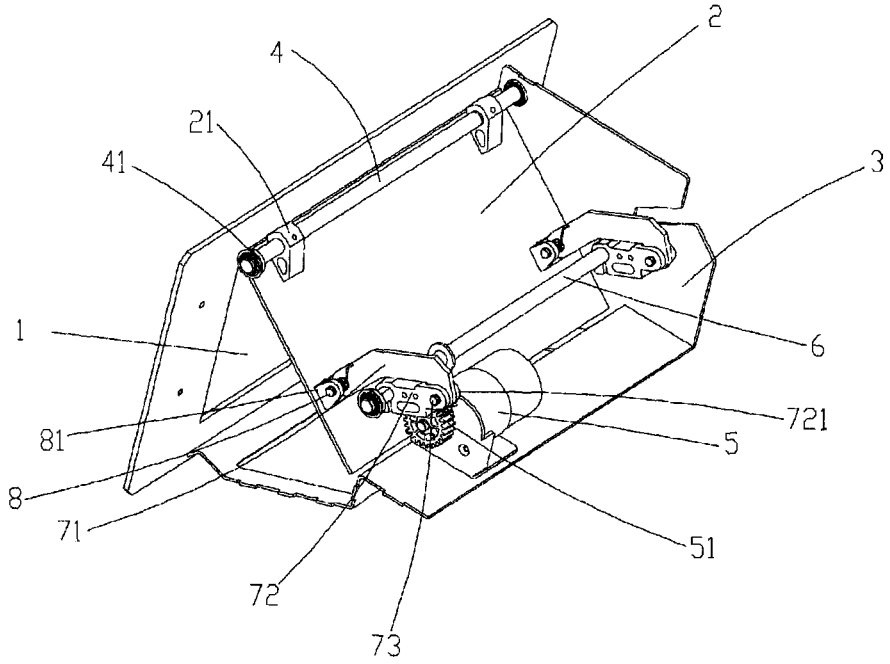
FIG. 3 is a schematic view of the gate in FIG. 1 when being in the completely opened state.
Figure 5:
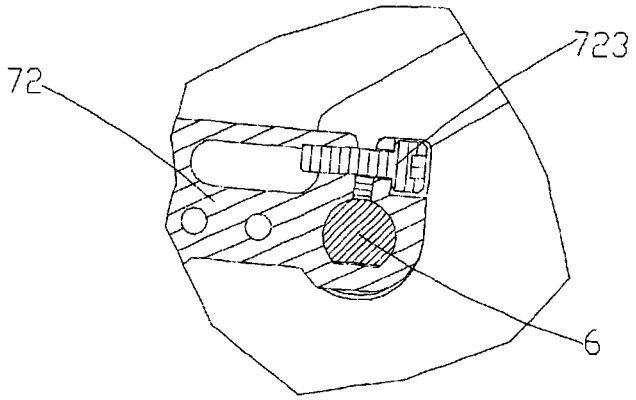
FIG. 5 is a schematic view of an adjustable rod embracing structure.

Referring to FIGS. 1 to 3, the preferred gate device of the cash inlet/outlet 1 applied in the financial self-service instrument according to the present invention includes an integral welded frame 3, a door 2 and a power transmission mechanism. The door 2 is of a plate shape. One side of the door 2 is installed to the frame 3 through a first rotation shaft 4 and is rotatable around the first rotation shaft 4. Specifically, a pair of shaft seats 21 is fixed on the back surface of the door 2, and the first rotation shaft 4 is fixed to the door 2 through the shaft seats 21. Two ends of the first rotation shaft 4 are connected to the frame 3 through a pair of bearings 41. After being installed, the door 2 may be rotated around the axis of the first rotation shaft 4, so as to open or close the cash inlet/outlet 1 of the financial self-service instrument. Certainly, the power to rotate the door 2 around the axis of the first rotation shaft 4 comes from the power transmission mechanism which is fixed on the frame 3. The power transmission mechanism includes an electric motor 5, a driving gear 51, a driven gear 52 and a pair of one-way folded connecting rod mechanisms 70. Specifically, the electric motor 5 is fixed on the frame 3, and drives the driving gear 51 to rotate in the clockwise or counterclockwise direction. The driven gear 52 is engaged with the driving gear 51, and is rotated in a reverse direction as the driving gear 51 rotates. The driven gear 52 is installed on a rotation shaft 6 which is installed on the frame 3 through a pair of bearings 61. The driven gear 52 is fixedly connected with the rotation shaft 6. When the driven gear 52 is rotated, the rotation shaft 6 is rotated synchronously. The pair of one-way folded connecting rod mechanisms 70 are connected between the rotation shaft 6 and the door 2, and located symmetrically at two ends of the rotation shaft 6. Specifically, each of one-way folded connecting rod mechanisms includes a first connecting rod 71 and a second connecting rod 72. One end of the first connecting rod 71 is connected to the door 2 through a rotation shaft 8. The rotation shaft 8 is fixed on the back surface of the door 2 through shaft seats 81. The rotation shaft 8 is disposed to parallel to the first rotation shaft 4, and located at the other side of the back surface of the door 2 opposite to the rotation shaft 4. One end of the second connecting rod 72 is hinged with the other end of the first connecting rod 71 through a shaft 73. Specifically, the end of the second connecting rod 72 adjacent to the first connecting rod 71 is formed into two extending sheets 721. The rotation shaft 73 fixedly passes through the two extending sheets 721. The first connecting rod 71 is hold between the two extending sheets 721 and is movably provided on the rotation shaft 73. The other end of the second connecting rod 72 is fixedly connected to the rotation shaft 6, and is rotated as the rotation shaft 6 rotates. As shown in FIG. 5, the second connecting rod 72 and the rotation shaft 6 are designed into a rod embracing structure. When assembling, the end of the second connecting rod 72 may clamp the rotation shaft 6 by adjusting a tightening screw 723. Such rod embracing design allows the second connecting rod 72 to be stably and fixedly connected to the rotation shaft 6 and be rotated as the rotation shaft 6 rotates, and may ensure that there is no slip between the second connecting rod 72 and the rotation shaft 6, thereby ensuring that two second connecting rods 72 of the pair of one-way folded connecting rod mechanisms 70 may be synchronously rotated as the rotation shaft 6 rotates. In this embodiment, when being rotated around the axis of the shaft 6, the two second connecting rods 72 may be effectively maintained in parallel, that is, they are not twisted.

When the electric motor 5 rotates in the counterclockwise direction as shown in FIG. 2, the driving gear 51 is rotated in the counterclockwise direction, and thus the driven gear 52 is rotated in the clockwise direction. Thus, the rotation shaft 6 and the second connecting rod 72 fixedly connected to the rotation shaft 6 are rotated in the clockwise direction. Since the second connecting rod 72 is hinged with the first connecting rod 71 through the shaft 73, the first connecting rod 71 is rotated when the second connecting rod 72 rotates in the clockwise direction. Specifically, the end of the first connecting rod 71 hinged with the second connecting rod 72 is raised, and thus the other end thereof connected to the rotation shaft 8 is raised, so as to draw the door 2 to rotate around the axis of the first rotation shaft 4, thereby opening the cash inlet/outlet 1 of the financial self-service instrument. As shown in FIG. 3, a schematic view of the gate when being in the completely opened state is shown, at this moment, the first connecting rod 71 and the second connecting rod 72 are approximately in parallel, and the second connecting rod 72 cannot drive the first connecting rod 71 to rotate in the clockwise direction, that is, the first connecting rod 71 and the second connecting rod are in folded state.

Figure 4:
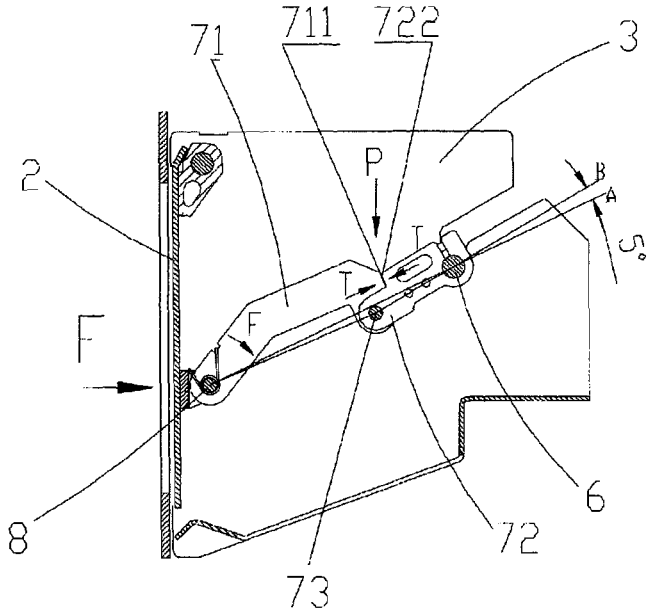
FIG. 4 is a schematic sectional view of the gate in FIG. 1 when being in the closed state.

Correspondingly, when the door 2 is to be closed, the electric motor 5 rotates in reverse direction, and drives the driving gear 51 to rotate in the clockwise direction, so that the driven gear 52 is rotated in the counterclockwise direction. Thus, the rotation shaft 6 and the second connecting rod 72 are rotated in the counterclockwise direction. The second connecting rod 72 pushes the first connecting rod 71 to move, and the first connecting rod 71 pushes the door 2 to rotate around the axis of the first rotation shaft 4 in the clockwise direction, thereby closing the door 2. As shown in FIG. 4, a schematic sectional view of the gate when being in the completely closed state is shown, at this moment, the first connecting rod 71 and the second connecting rod 72 are in an approximate straight state. The end of the first connecting rod 71 adjacent to the shaft 73 has an end surface 711, and the second connecting rod 72 has an end surface 722 cooperated with the end surface 711 of the first connecting rod 71. At this moment, as shown in FIG. 4, the end surface 711 and the end surface 722 butt against with each other, so that the second connecting rod 72 cannot be continuously rotated in the counterclockwise direction, thereby the door 2 being in the closed state.

At this moment, if the door is pushed by an external force F, the external force F is transmitted to the second connecting rod 72 through the first connecting rod 71 in a direction of connecting line between the axes of the shaft 8 and the shaft 73. Since the axis of the shaft 73 is positioned below the connecting line between the axis of the shaft 8 and the axis of the shaft 6, the second connecting rod 72 would only be rotated around the axis of the shaft 6 in the counterclockwise direction, so that the first connecting rod 71 have to swing around the axis of the shaft 8 in the clockwise direction. However, the door has been in the closed state, and the end surface 711 of the end of the first connecting rod 71 adjacent to the shaft 73 and the end surface 722 of the end of the second connecting rod 72 adjacent to the shaft 73 have been butted against with each other, so the second connecting rod 72 cannot be rotated around the axis of the shaft 6 in the counterclockwise direction, and the first connecting rod 71 cannot swing around the axis of the shaft 8 in the clockwise direction, thereby achieving the self-locking state of the connecting rod mechanisms 70. Besides, when the external force F is increased, the interaction force between the end surface 711 of the first connecting rod 71 and the end surface 722 of the second connecting rod 72 is also increased, meanwhile, the shearing force exerted to the shaft 73 is also increased, which may effectively prevent the gate device from being illegally opened by the external force F.

As can be known from the above description, in order to prevent the gate device from being illegally opened by an external pushing force, it is necessary to ensure that, when being transmitted through the one-way folded connecting rod mechanism, the external force F cannot generate a component force, at the shaft 73, which may drive the connecting rod 72 to rotate around the shaft 6 in the clockwise direction. According to the principle of the mechanics transmission, in order to achieve the above object, there is a particular position relationship between the shaft 8, the connecting rod 71, the shaft 73, the connecting rod 72 and the shaft 6, i.e., the shaft 73 cannot be positioned above the connecting line A between the axis of the rotation shaft 8 and the axis of the rotation shaft 6. That is, the axes of the shaft 8, the shaft 73 and the shaft 6 should be in the same line, or the shaft 73 should be positioned below the connecting line A between the axes of the rotation shaft 8 and the rotation shaft 6. If a connecting line B is assumed between the axis of the shaft 73 and the axis of the rotation shaft 6, a separation angle is formed between the connecting line A and the connecting line B. Thus, since the end surfaces 711, 722 abut against with each other, the first connecting rod 71 cannot be rotated around the shaft 73 in the clockwise direction under the external force F, and thus the door 2 cannot be opened because the first connecting rod 71 cannot be rotated in the clockwise direction. If the door 2 is to be opened by rotating the first connecting rod 71 around the shaft 73 in the counterclockwise direction, the weight P of the connecting rod can be overcome only by the power of internal electric motor. That is, the shaft 6 is rotated and drives the second connecting rod 72 to rotate in the clockwise direction, so that the shaft 73 goes across the connecting line A between the shaft 8 and the shaft 6, and drives the connecting rod 71 to rotate, thereby opening the gate. In the embodiment, the separation angle between the connecting line A and the connecting line B is 5 degree. Of cause, the separation angle may be any appropriate degree according to an actual requirement, preferably is in the range of 0 to 10 degree.

Figure 6:
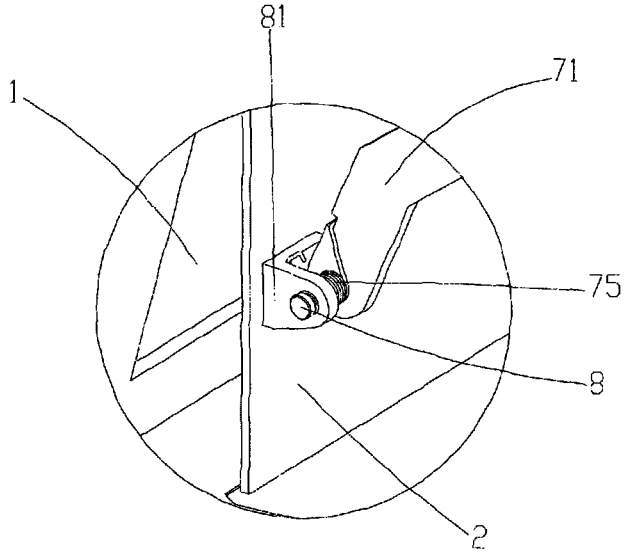
FIG. 6 is a partial enlarged schematic view of portion A in FIG. 2.

In addition, in order to further prevent the gate device from being illegally opened, referring to FIG. 6, a torsion spring 75 is provided on the rotation shaft 8. One end of the torsion spring 75 is fixed in a location groove 712 formed in an upper side surface of the first connecting rod 71, and the other end of the torsion spring 75 is fixed to the shaft seat 81 of the rotation shaft 8. The torsion spring 75 provides a force of rotating the first connecting rod 71 around the rotation shaft 8 in the clockwise direction, so that the first connecting rod 71 and the second connecting rod 72 are kept in the locked state when the door 2 is in the closed state. Therefore, the provision of the torsion spring 75 may effectively control the jump of the rotation shaft 73 of the connecting rods 71 and 72 in upward or downward direction caused by the vibrating force from the outer side of the door plate, and prevent self-lock of the one-way folded connecting rod mechanism 70 from failing caused when the jump of the rotation shaft 73 in upward or downward direction goes across the connecting line between the axis of the rotation shaft 74 and the axis of the rotation shaft 6. In other words, when a person attempts to apply the external force F to rotate the first connecting rod 71 in the counterclockwise direction and open the door 2, it is also necessary to overcome the torsion force of the torsion spring 75 to raise the shaft 73 such that the first connecting rod 71 is rotated in the counterclockwise direction. Therefore, due to the provision of the torsion spring 75, it becomes more impossible to illegally open the door 2 by attempting to rotate the first connecting rod 71 in the counterclockwise direction under the external force F.

Therefore, the gate device according to the present invention may be self-locking by the one-way folded connecting rod mechanism, and has a function of preventing the gate device from being violently and illegally opened. Besides, the one-way folded connecting rod mechanism has a simplified structure and a low cost.

Figure 7:
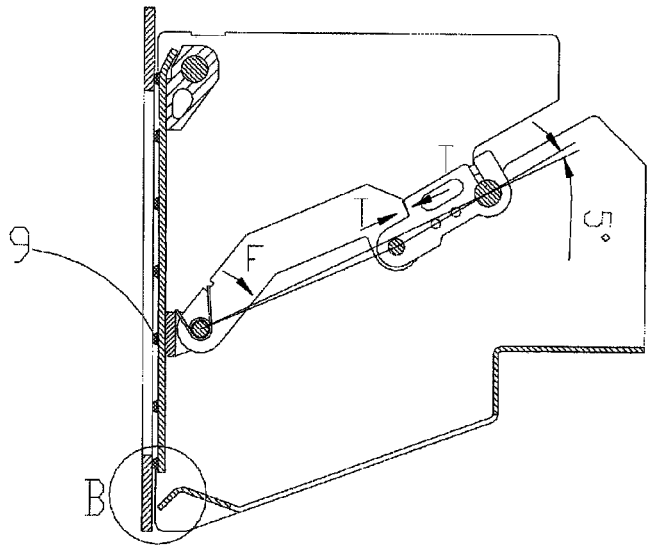
FIG. 7 is a schematic sectional view of another preferred gate device according to the invention when being in the closed state.
Figure 8:
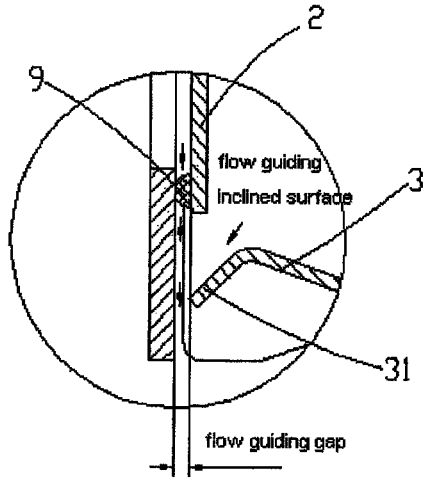
FIG. 8 is a partial enlarged schematic view of portion B in FIG. 7.

In addition, except for attempts to open the gate by violent force, criminals often take means such as inserting foreign matters or applying liquid glues, so that the gate device works abnormally, in order to obtain an opportunity to destroy the gate device to steal the cash in the financial self-service instrument. In order to prevent the gate device from being inserted foreign matters and filled liquid glues by criminals, referring to FIGS. 7 and 8, another preferred embodiment is also provided in the present invention. As shown in FIG. 7, the difference between this embodiment and the embodiment shown in FIG. 4 lies in that, a plurality of POM plastic sphere convex dots 9 are provided at peripheral edges of the front surface of the door 2, wherein the front surface of the door 2 is engagable with a cash inlet/outlet of the financial self-service instrument, and the peripheral edges of the door 2 are engagable with the peripheral edges of the cash inlet/outlet. The POM plastic sphere convex dots 9 are arranged and fixed at the peripheral edges of the door plate equidistantly. When the door 2 is in the closed state, the POM plastic anti-sticking sphere convex dots 9 are in contact with the panel of the financial self-service instrument, and a flow guiding gap is formed between the door 2 and the panel, foreign matters which are larger than the distance between the POM plastic sphere convex dots 9 and the flow guiding gap between the door and the panel cannot be inserted. In addition, since commonly used liquid glues such as 502 and AA do not stick POM plastic and the POM plastic sphere convex dots are in contact with the panel of the financial self-service instrument, the contact area between the door 2 and the panel of the financial self-service instrument may be greatly reduced. Thus, referring to FIG. 8, when the liquid flows into the financial self-service instrument through the gap between the panel of the financial self-service instrument and the door 2, the liquid may flow through the space between the POM plastic sphere convex dots and the flow guiding gap between the door and the panel, and then flow out via a flow guiding inclined surface 31 (so do the dust and the water). Since remnant glue on the contact surface between the POM plastic anti-sticking sphere convex dots and the panel of the financial self-service instrument doesn't stick the POM plastic, the door may be opened by a torque of the door opening electric motor which is slight larger than the normal torque. Therefore, the provision of the POM plastic sphere convex dots may effectively both prevent foreign matters or liquid from filling into the financial self-service instrument through the gate device by criminals, and prevent the gate device from being damaged with the liquid glues available in the market by criminals, and thus perform a safeguard function.

While the preferred embodiments of the present invention have been described above, it is not intended to limit the protection scope of the present invention. Therefore, various equivalent variations made by those skilled in the art based on the contents described in the Description and illustrated in drawings of the present invention are deemed to fall into the protection scope of the present invention.

What is claimed is:

1. A self-locking gate device, installed in a financial self-service instrument and configured to open or close a cash inlet/outlet of the financial self-service instrument, wherein the self-locking gate device comprises:

an integral welded frame;

a door installed on the frame through a first rotation shaft and being rotatable around the first rotation shaft; and a power transmission mechanism fixed on the frame and providing a power for a rotation of the door;

wherein the power transmission mechanism comprises an electric motor and a pair of one-way foldable connecting rod mechanisms, each of the one-way foldable connecting rod mechanisms comprises a first connecting rod and a second connecting rod, one end of the first connecting rod and one end of the second connecting rod are hinged together through a second shaft, the other end of the first connecting rod is connected to the door through a third shaft, the third shaft and the first rotation shaft are disposed in parallel and are respectively located at two opposite ends of the door, the other end of the second connecting rod is connected to the electric motor through a fourth shaft, the electric motor drives and rotates the fourth shaft, the second connecting rod and the fourth shaft are fixedly connected together via a rod embracing structure, and the second connecting rod is configured to clamp the fourth shaft through a screw, and the pair of one-way foldable connecting rod mechanisms are connected between the door and the fourth shaft, and the pair of one-way foldable connecting rod mechanisms are symmetrically located at two ends of the fourth shaft; and an end of the first connecting rod adjacent to the second shaft has a first end surface, and an end of the second connecting rod adjacent to the second shaft has a second end surface, when the cash inlet/outlet of the financial self-service instrument is closed by the door, the first end surface and the second end surface abut against each other, so as to stop a folding operation formed by rotating the first connecting rod in a clockwise direction and rotating the second connecting rod in a counterclockwise direction;

when the cash inlet/outlet is closed by the door, the second shaft is located below a connecting line A between axes of the third shaft and the fourth shaft, a connecting line between axes of the second shaft and the fourth shaft is indicated as B, and a separation angle formed between connecting lines A and B is larger than 0 degree and smaller than or equal to 10 degrees; and a torsion spring is provided on the third shaft, an end of the torsion spring is fixedly connected to the door, the other end of the torsion spring is fixed in a location groove formed in an upper side surface of the first connecting rod, the torsion spring is configured to exert a force to the first connecting rod so as to urge the first connecting rod to rotate around the third shaft in the clockwise direction.

2. The self-locking gate device according to claim 1, wherein the power transmission mechanism further comprises a driving gear and a driven gear engaged with the driving gear, the driven gear is installed on the fourth shaft so as to rotate the fourth shaft.

3. The self-locking gate device according to claim 2, wherein edges of the door engaged with the cash inlet/outlet of the financial self-service instrument are provided with polyoxymethylene plastic sphere convex dots.

4. The self-locking gate device according to claim 1, wherein edges of the door engaged with the cash inlet/outlet of the financial self-service instrument are provided with polyoxymethylene plastic sphere convex dots.

5. The self-locking gate device according to claim 4, wherein the polyoxymethylene plastic convex sphere convex dots are distributed uniformly and equidistantly.

* * * * *